US008584391B1

(12) United States Patent
Calvert

(10) Patent No.: US 8,584,391 B1
(45) Date of Patent: Nov. 19, 2013

(54) TACTICAL TELESCOPING SHOTGUN

(71) Applicant: TTSG Associates, Trustee for TTSG Trust, Manassas, VA (US)

(72) Inventor: S. Mill Calvert, Manassas, VA (US)

(73) Assignee: TTSG Associates, Manassas, VA (US), Trustee for TTSG Trust ( * ) Notice: Subject to any disclaimer, the term of this patent is extended or adjusted under 35 U.S.C. 154(b) by 0 days.

(21) Appl. No.: 13/928,917

(22) Filed: Jun. 27, 2013

(51) Int. Cl.
*F41A 21/06* (2006.01)

(52) U.S. Cl.
USPC ..... 42/79; 42/76.01; 42/77; 89/14.05

(58) Field of Classification Search
USPC ..... 42/76.01, 77, 79; 89/14.05
See application file for complete search history.

(56) References Cited

U.S. PATENT DOCUMENTS

| | | | | | |
|---|---|---|---|---|---|
| 570,145 | A * | 10/1896 | Pittavino | 42/72 |
| 855,439 | A * | 6/1907 | Adrianson | 42/59 |
| 927,572 | A * | 7/1909 | Michaud | 42/79 |
| 966,889 | A * | 8/1910 | Devol | 42/76.01 |
| 1,297,891 | A * | 3/1919 | Moor | 42/77 |
| 2,466,400 | A * | 4/1949 | Ennis | 42/79 |
| 2,845,741 | A * | 8/1958 | Day | 42/76.01 |
| 3,226,871 | A * | 1/1966 | Sargeant et al. | 42/79 |
| 3,284,942 | A * | 11/1966 | Moseley | 42/79 |
| 3,666,311 | A * | 5/1972 | McMullin | 29/750 |
| 4,722,261 | A * | 2/1988 | Titus | 89/7 |
| 4,757,741 | A * | 7/1988 | Brothers | 89/14.05 |
| 4,841,657 | A * | 6/1989 | Mossberg | 42/76.01 |
| 5,123,329 | A * | 6/1992 | Irwin | 89/161 |
| 5,309,814 | A * | 5/1994 | Mossberg | 89/14.6 |
| 5,452,535 | A * | 9/1995 | See et al. | 42/79 |
| 6,116,137 | A * | 9/2000 | Strahan | 89/196 |
| 6,490,959 | B2 * | 12/2002 | Lavin | 89/161 |
| 6,598,329 | B1 * | 7/2003 | Alexander | 42/71.01 |
| 6,789,343 | B1 * | 9/2004 | Dietrich et al. | 42/79 |
| 6,983,742 | B2 * | 1/2006 | Jordan et al. | 124/56 |
| 2002/0029688 | A1 * | 3/2002 | Lavin | 89/161 |
| 2002/0088162 | A1 * | 7/2002 | Toivanen | 42/77 |
| 2012/0240443 | A1 * | 9/2012 | Washam, Jr. | 42/79 |

* cited by examiner

*Primary Examiner* — Bret Hayes
*Assistant Examiner* — Derrick Morgan
(74) *Attorney, Agent, or Firm* — Louis Ventre, Jr.

(57) ABSTRACT

A shotgun has a telescoping barrel made of concentric barrel sections slidably engaged together. These include at least an inner barrel section and an outer barrel section. A grip on the outer barrel section aids telescopic movement. A locking pin secures or releases the barrel sections. The barrel sections have protrusions that interfere with further outward movement once fully telescoped out. The grip may have a channel to permit a pistol grip to slide onto the grip. A second pistol grip may be connected to the trigger. The butt of the gun may slide out to make a shoulder rest. A butt plate is connected to a rod that slides into and out of the shotgun. The rod has teeth that engage a spring-loaded arm to secure the rod in an extended position. A compression or tension spring may bias the concentric barrel sections in an extended or shortened configuration.

6 Claims, 2 Drawing Sheets

TACTICAL TELESCOPING SHOTGUN

TECHNICAL FIELD

In the field of firearms, a shotgun with a telescoping barrel enabling situational adjustment of the shotgun pellet pattern.

BACKGROUND ART

A shotgun is also known as a scattergun, a coach gun and a riot gun. A shotgun is a firearm that typically designed to fire a shell holding numerous pellets called shot. The pellets fired from a shotgun spread upon leaving the barrel. Typically, the spread of shotgun used for hunting at 25 feet away, averages about 8 inches.

Shotguns come in a wide variety of barrel lengths, typically from 18 inches to 29 inches. The barrel length significantly affects the spread of the shot at the target, where shorter barrels deliver greater shot spread at any given distance with range. For civilian use, many countries establish a legal minimum barrel length that precludes easy concealment. In the United States, the minimum barrel length for civilian use is 18 inches (460 mm). Such laws are generally inapplicable to police and military authorities.

The military value of the shotgun was evidenced by its use during World War I by U.S. troops. Doughboys were issued 12-gauge pump action shotguns for use in close-quarters trench fighting to great effect. In jungle combat during World War II and Vietnam shotguns were common and effectively used when relatively close combat encounters could be expected. In urban combat situations, such as experienced in Iraq, shotguns were used to great effect to defeat the locks on doors when entering a building.

Shotguns are common weapons aboard naval vessels, which employ shotguns for shipboard security because the weapon is effective in repelling enemy boarding parties. Shotguns are also commonly used by military police units.

For both law enforcement and military engagements, the spread of pellets from a shotgun provides a tactical advantage in close quarters combat, such as within a building. The shotgun is widely used as a support weapon by police forces and specialized police and defensive shotguns are called riot shotguns.

SUMMARY OF INVENTION

A shotgun has a telescoping barrel made of concentric barrel sections slidably engaged together. The concentric barrel sections include at least an inner barrel section and an outer barrel section forming a muzzle. The inner barrel section has a smaller diameter than the outer barrel section. A grip is attached to the outer barrel section to aid in a shooter telescoping the outer barrel section to either an extended, elongated position or a contracted, shortened position. A locking pin secures or releases the concentric barrel sections for telescopic movement. The concentric barrel sections are prevented from moving off each other by protrusions that interfere with further movement once fully telescoped out. A first protrusion near the distal end of the inner barrel section engages a second protrusion near the proximal end of the outer barrel section to stop the outward slide of the outer barrel section. The grip may have a channel to permit a pistol grip to slide onto the grip. The shotgun preferably has a second pistol grip connected to the trigger. The butt of the gun may slide out of the second pistol grip to provide an extension to rest on a shooter's shoulder. The mechanism for sliding the butt includes a butt plate connected to a rod that slides into and out of the shotgun. The rod has teeth that engage a spring-loaded arm to secure the rod in an extended position. The shotgun may include a compression or tension spring to bias the concentric barrel sections in an extended or shortened configuration.

Technical Problem

A typical shotgun is too big and clumsy to carry along with other weaponry. Its physical length, weight and bulk can discourage its use and availability by a soldier or policeman.

When a soldier, SWAT team member, or police office is using an assault shotgun, he often has time for only one shot to kill a terrorist before he himself is shot. If the soldier has an assault shotgun and he turns a corner in a building and is confronted with a terrorist pointing a gun at him, he as a good chance of firing a shot whereby a narrow width shot pattern will probably direct enough pellets into the terrorist to disable him.

When the same soldier with the assault shotgun turns a corner in a building and is confronted with multiple terrorists or enemy combatants who are spread out, the soldier is highly vulnerable because the narrow pellet pattern of a standard shotgun is not wide enough to disable more than one terrorist or enemy combatant.

Solution to Problem

The solution is an assault shotgun that is as small and lightweight as a pistol having a wide pellet pattern to disable multiple dispersed terrorists with a single shot and yet can be instantly changed into a scattergun with a standard narrower pellet pattern for single enemy or terrorist engagements.

Advantageous Effects of Invention

The tactical telescoping shotgun will save lives of soldiers, swat team members and police officers because it enables the shooter to instantly enlarge or contract the shot pattern from the shotgun to address the tactical situation.

Because the tactical telescoping shotgun is light and compact, many more soldiers could easily carry the gun with them in addition to their M-16 or rifle.

The tactical telescoping shotgun could be manufactured with an Allen Key set screws to "permanently" lock the barrel in its longer position so it would be legal for the average citizen to own.

The tactical telescoping shotgun eliminates the problem of being stuck with a narrow shot pattern that all other assault shotguns have.

The tactical telescoping shotgun could save the lives of soldiers, SWAT team members, and police officers in the war on terrorism.

BRIEF DESCRIPTION OF DRAWINGS

The drawings illustrate preferred embodiments of the tactical telescoping shotgun according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
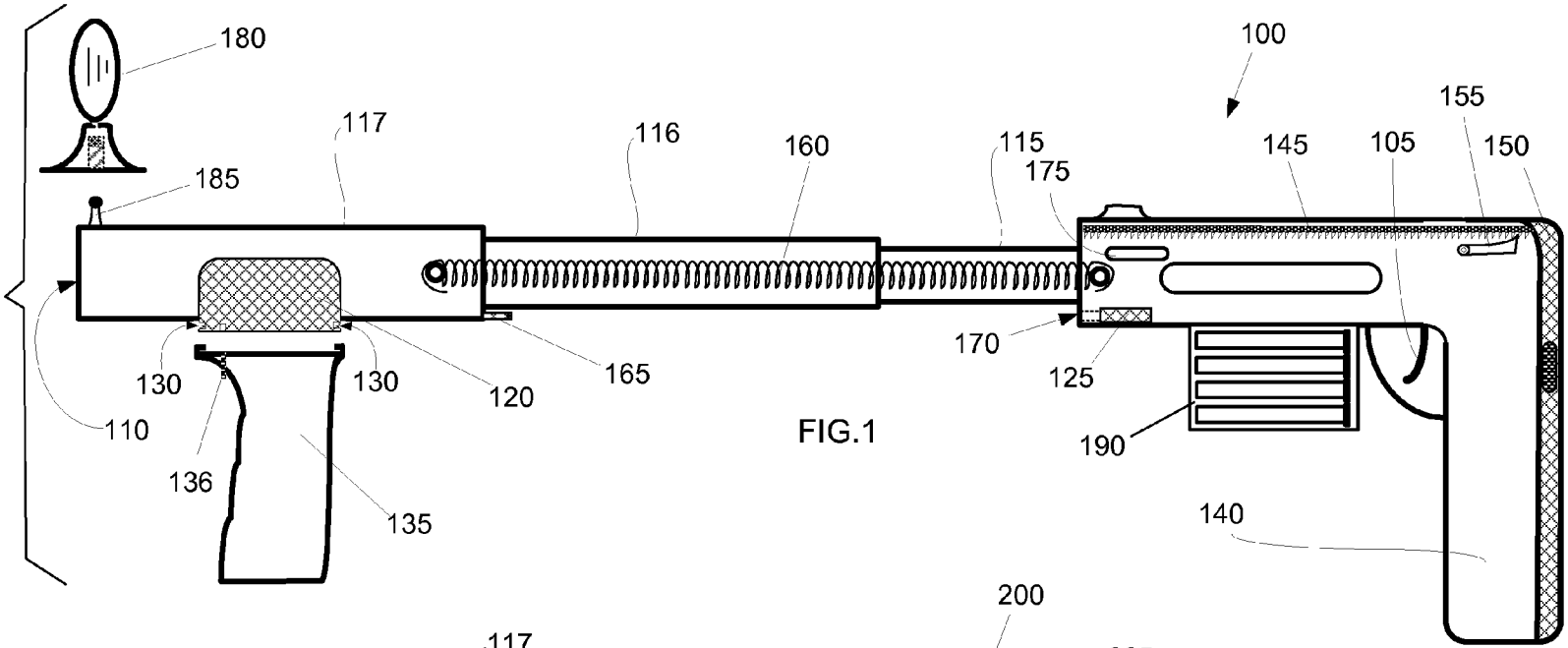
FIG. 1 is a side elevation view of a tactical telescoping shotgun.

FIG. 1 is a side elevation view of a shotgun (100) having a trigger (105) and a muzzle (110). The muzzle is the discharge end of the barrel. The shotgun (100) is preferably a semi-automatic or automatic weapon where the shells are fed from a magazine (190).

The shotgun (100) has a telescoping barrel (200), which in the example shown in FIG. 1 is made of three concentric barrel sections. The telescoping barrel (200) may be made of two concentric barrel sections, or more than three concentric barrel sections. The concentric barrel sections slide out to a maximum length equal to about the sum of the lengths of each concentric barrel section present in the telescoping barrel (200), or slide in to a minimum length equal to about the size of the longest length concentric barrel section. The stated minimum and maximum lengths are approximate because there is some overlap of the concentric barrel sections. Thus, the telescoping barrel (200) includes a plurality of concentric barrel sections slidably engaged together.

In an embodiment with a minimum of two concentric barrel sections in the plurality of concentric barrel sections, there is an inner barrel section (115) that is nearer to the trigger (105) than any of the other barrel sections in the plurality of barrel sections; and an outer barrel section (117) forming the muzzle (110). The inner barrel section (115) is preferably in a non-movable position and the other barrel sections slide with respect to the inner barrel section (115). It is possible to have an embodiment where the inner barrel section (115) slides a distance into the body of the shotgun (100) towards the trigger (105).

Figure 2:
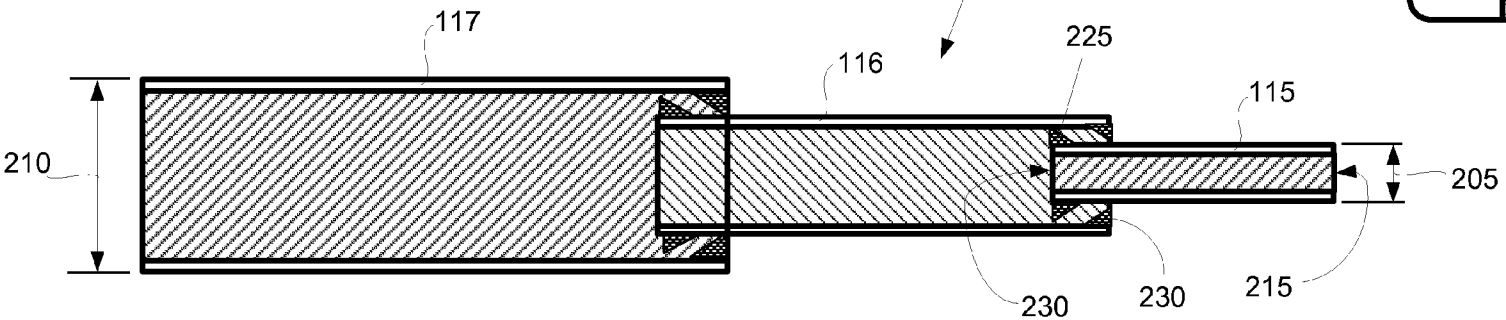
FIG. 2 is a side sectional view of three concentric barrel sections.
Figure 4:
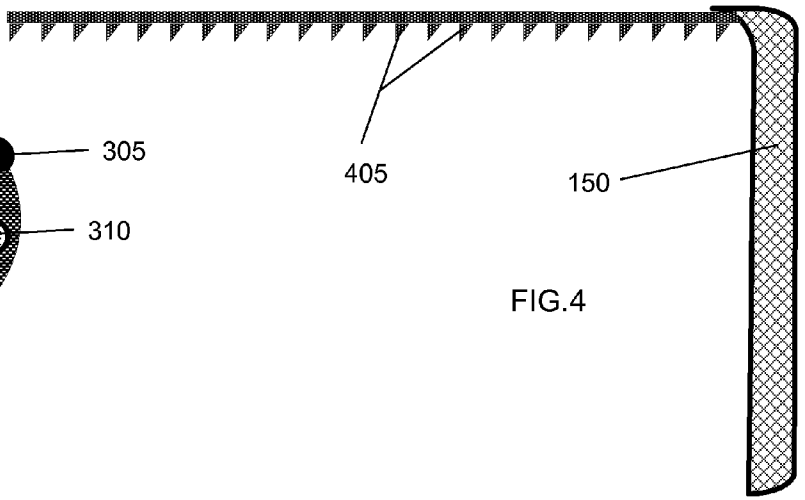
FIG. 4 is a side elevation view of a butt plate and rod showing teeth on the rod.
Figure 3:
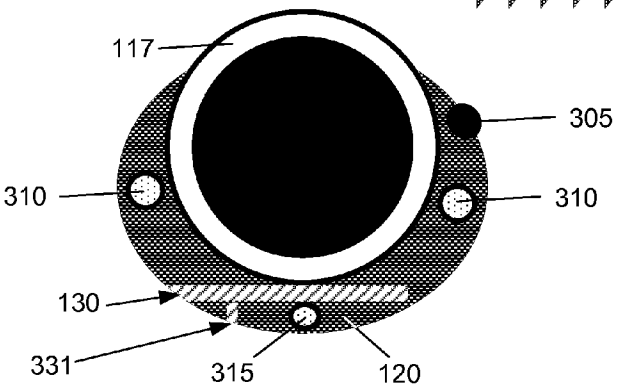
FIG. 3 is an end view of an outer barrel section.
Figure 5:
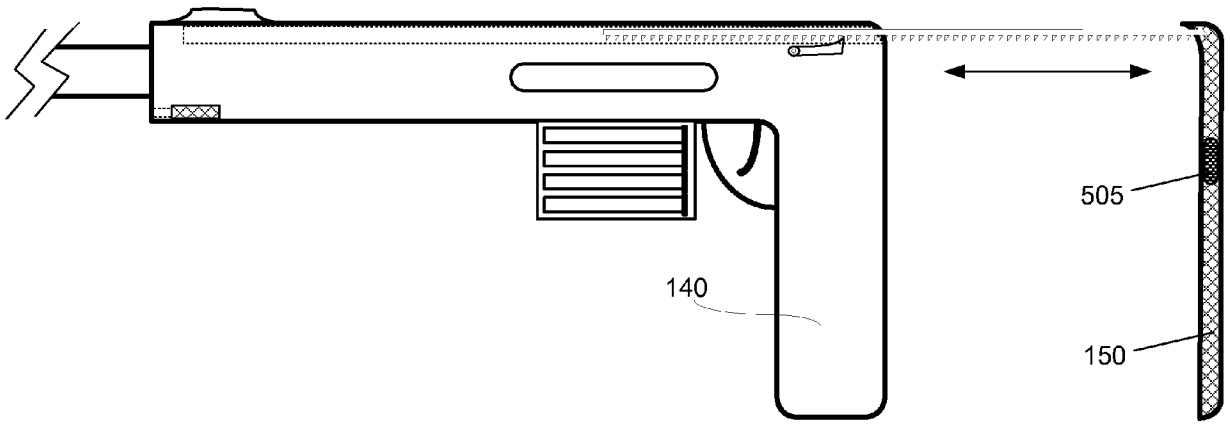
FIG. 5 is a side elevation view of a portion of the tactical telescoping shotgun showing the butt plate and rod extended from the gun.

Because the concentric barrel sections are telescoping, each barrel section extending further from the trigger (105) than the inner barrel section (115) is larger in diameter than the one preceding it. Thus, in the embodiment with two concentric barrel sections, the inner barrel section (115) has a first diameter (205) that is smaller than a second diameter (210) of the outer barrel section (117). If there were three concentric barrel sections as shown in FIG. 1 and FIG. 2, the one in the middle, called a middle barrel section (116), would be larger in diameter than the inner barrel section (115) and smaller in diameter than the outer barrel section (117). Thus, the middle barrel section (116) slidably fits over the inner barrel section (115) and slidably fits within the outer barrel section (117). This relationship is inherent in a telescoping barrel (200).

The concentric barrel sections may be made of a composite or carbon fiber material to make the shotgun (100) lighter. The inner barrel section (115) is preferably made of metal because it takes the majority of the explosive force and impels the shot towards the muzzle (110). The inner barrel section (115) is preferably fixed in place, that is, it does not itself slide, even though the other barrel sections slide with respect to the inner barrel section (115).

The shotgun (100) includes a grip (120) attached to the outer barrel section (117), such that a shooter may telescope the outer barrel section (117) by grasping the grip (120) and exerting force to slide the outer barrel section (117) in a direction that is either outward with respect to the inner barrel section (115) setting the telescoping barrel (200) in an extended position, or inward with respect to the inner barrel section (115) setting the telescoping barrel (200) in a contracted position.

The grip (120) may include a channel (130) that slidably receives a pistol grip (135). While there may be one channel (130) down the center of the pistol grip (135), there are preferably two channels on the front and rear of the pistol grip (135) so that the sliding direction is transverse to the motion of the telescoping barrels. The pistol grip (135) secures to the grip (120) by sliding into the channel (130). It may be secured in place by a securing bar (136) on the grip (120) that seats in a receiving hole (331) in the pistol grip (135).

The grip (120) may further include: a push button (305) to turn LED lights (310) on and off and a laser sight (315) which aid in finding and aiming at targets.

The shotgun (100) includes a locking pin (165) that may be manipulated to secure or release one or more concentric barrels sections in the plurality of concentric barrel sections for telescopic movement. Preferably, the locking pin (165) is located on the outer barrel section (117) and has a ridge at its free end. The locking pin (165) is preferably spring biased to engage a mating ridge or receiving hole within the shotgun (100). Preferably, the locking pin (165) automatically engages when the outer barrel section (117) is fully contracted and the ridge slides into a receiving port (170) past the mating ridge or into the receiving hole. Preferably, a push down on a release button (125), or a slide of the release button (125), releases the locking pin (165) so that the outer barrel section (117) may be telescoped out.

The shotgun (100) preferably includes a structural mechanism that precludes sliding any concentric barrel section off the end of another. One embodiment of such structural mechanism includes placing stops near the sliding extremities of the concentric barrel sections.

For example, where each concentric barrel section in the plurality of concentric barrel sections includes a proximal end (215) closest to the trigger (105) and a distal end (220) furthest from the trigger (105), there is preferably a first protrusion (225) near the distal end (220) of the inner barrel section (115) and a second protrusion (230) near the proximal end (215) of the outer barrel section (117). The second protrusion (230) engages the first protrusion (225) to stop the outward movement of the outer barrel section (117). When additional concentric barrel sections are present, each would have similarly located protrusions.

In other examples, the protrusions may be square, rectangular, triangular or any other shape that accomplishes the purpose. They may circle the barrel perimeter or occupy only an arc segment. Preferable protrusion shapes are triangular and occupy the entire perimeter of each concentric barrel section at the end where the protrusions mate to stop the outward movement of the concentric barrel sections. Triangular-shaped protrusions mate to create a rectangular cross section when stopping the outer motion of the concentric barrel sections.

The shotgun (100) preferably includes a butt plate (150) that is extensible to slide out and provide a brace for shooting from the shoulder like a hunting shotgun. The mechanism enabling extension includes a rod (145) that is slidably engaged within the shotgun (100) and configured to slide and extend out from the shotgun (100). The rod (145) has teeth (405) that can be engaged to stop and lock the butt plate (150) in position. The butt plate (150) connects to the rod (145) such that the butt plate (150) fits against the second pistol grip (140) when the rod (145) is fully retracted within the shotgun (100). A spring-loaded arm (155) biased to engage the teeth (405) and lock the rod (145) in a fixed position when the rod (145) is extended out from the shotgun (100) or when it is fully retracted. A finger pull (505) on one or on opposite sides of the butt plate (150) makes it easier to reposition the butt plate (150). The butt plate (150) is preferably molded to comfortably conform to and become part of the second pistol grip (140) when the butt plate (150) is fully retracted.

The shotgun (100) may also include a spring (160) to bias the plurality of concentric barrel sections in an extended configuration or a shortened configuration once the release button (125) is released. A tension spring is used to bias the plurality of concentric barrel sections into a shortened configuration. A compression spring is used to bias the plurality of concentric barrel sections into an extended configuration. A locking mechanism may be added to retain the concentric barrel sections in an extended position.

The shotgun (100) preferably includes a second pistol grip (140) connected to the trigger (105) as shown in FIG. 1. It also may include a strap fitting (175) so that the shotgun (100) can be easily carried with a strap around the neck for ready access when needed in combat or law enforcement circumstances. The shotgun (100) may further include a 2-sided mirror disk (180) to permit the shooter to look around corners. Preferably the 2-sided mirror disk (180) fits atop the front sight (185), which is configured with a small metal ball at its peak. In this embodiment, the 2-sided mirror disk (180) has a receiving volume that removably and rotatably seats on the small metal ball.

The shotgun (100) may be manufactured with an Allen Key set screws through the sidewalls of the concentric barrel sections to lock the telescoping barrel (200) in its extended position. The set screws would engage the immediately smaller barrel to prevent sliding. This configuration could be more or less "permanent" by welding or sealing the set screws in place, so that the shotgun (100) would meet legal requirements for barrel length for civilian use.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the firearms industry.

What is claimed is:

1. A shotgun having a trigger and a muzzle, the shotgun comprising:

a telescoping barrel;

the telescoping barrel comprising a plurality of concentric barrel sections slidably engaged together;

the plurality of concentric barrel sections comprising: an inner barrel section that is nearer to the trigger than any of the other barrel sections in the plurality of barrel sections; and an outer barrel section forming the muzzle;

the inner barrel section having a first diameter smaller than a second diameter of the outer barrel section;

a grip attached to the outer barrel section, such that a shooter may telescope the outer barrel section by grasping the grip and exerting force to slide the outer barrel section in a direction that is either outward with respect to the inner barrel section setting the telescoping barrel in an extended position, or inward with respect to the inner barrel section setting the telescoping barrel in a contracted position; and a locking pin that may be manipulated to secure or release one or more concentric barrel sections in the plurality of concentric barrel sections for telescopic movement; and a spring to bias the plurality of concentric barrel sections in an extended or shortened configuration once the locking in is released.

2. The shotgun of claim 1, wherein each concentric barrel section in the plurality of concentric barrel sections comprises a proximal end closest to the trigger and a distal end furthest from the trigger; the shotgun further comprising:

a first protrusion near the distal end of the inner barrel section; and a second protrusion near the proximal end of the outer barrel section that engages the first protrusion to stop outward movement of the outer barrel section.

3. The shotgun of claim 1, wherein the plurality of concentric barrel sections further comprises a middle barrel section slidably fitting over the inner barrel section and slidably fitting within the outer barrel section.

4. The shotgun of claim 1, wherein the grip comprises a channel and the shotgun further comprises a pistol grip that secures to the grip by sliding into the channel.

5. The shotgun of claim 1, further comprising a second pistol grip connected to the trigger.

6. The shotgun of claim 5, further comprising:

a rod slidably engaged within the shotgun and configured to slide and extend out from the shotgun, the rod comprising teeth;

a butt plate connected to the rod such that the butt plate fits against the second pistol grip when the rod is fully retracted within the shotgun; and a spring-loaded arm biased to engage the teeth and lock the rod in a fixed position when the rod is extended out from the shotgun.

* * * * *